United States Patent [19]

Scott

[11] 4,001,737

[45] Jan. 4, 1977

[54] CAVITY TUNING ASSEMBLY HAVING COARSE AND FINE TUNING MEANS

[75] Inventor: James E. Scott
Austell, Ga.

[73] Assignee: The United States of America as represented by the Field Operations Bureau of the Federal Communications Commission

[22] Filed: Oct. 24, 1975

[21] Appl. No.: 625,747

[52] U.S. Cl. ..... 333/83 R; 403/104; 403/290

[51] Int. Cl.[2] ..... H01P 7/06

[58] Field of Search ..... 333/73 R, 73 W, 83 R, 333/82 R, 82 B; 334/70, 74–77; 403/104, 109, 290, 343; 315/5.46, 5.53, 39.55; 317/253; 324/58 R, 58 C, 58.5 C

[56] References Cited

UNITED STATES PATENTS

| | | | |
|---|---|---|---|
| 1,633,870 | 6/1927 | Potter | 317/253 |
| 1,944,601 | 1/1934 | Gulich | 403/290 X |
| 2,851,666 | 9/1958 | Kach | 333/83 R X |
| 3,697,893 | 10/1972 | Faustlin et al. | 333/83 R X |

*Primary Examiner*—Paul L. Gensler
*Attorney, Agent, or Firm*—Wm. Ferrel Bentley

[57] ABSTRACT

A cavity tuning assembly for use in a tuned cavity having provisions for coarse tune adjustment and fine tune adjustment for changing the frequency of the cavity's resonance. Coarse tune adjustment is obtained by sliding an unthreaded cavity tuning rod of the cavity tuning assembly up and down through a threaded bushing to obtain rough tune whereupon the unthreaded rod is locked into place by way of a knurl nut compressing a split end portion of a shaft lock screwed onto the threaded bushing into friction engagement around the cavity tuning rod. Fine tune adjustment is obtained by rotating the unthreaded rod into engagement with the shaft lock and the threaded bushing causing the threaded bushing and engaged structure to screw into or out of a pipe reducer to obtain fine tune which is then locked against the threaded bushing by a lever lock nut.

9 Claims, 3 Drawing Figures

CAVITY TUNING ASSEMBLY HAVING COARSE AND FINE TUNING MEANS

CROSS - REFERENCES TO RELATED APPLICATIONS

None.

BACKGROUND OF THE INVENTION

1. Field of the Invention

The present invention relates generally to improvements in a tuned cavity, and more particularly pertains to a new and improved cavity tuning assembly wherein provisions are provided for a coarse tune adjustment and a fine tune adjustment of an unthreaded cavity tuning rod.

2. Description of the Prior Art

In the field of tuned resonant frequency cavities such as bandpass filters or notch filters, it has been the general practice to employ a finely threaded tuning rod shaft for changing the tuned frequency of the cavity's resonance. Finely threaded tuning rod shafts, also referred to as cavity plunger threaded rods, are utilized in that usually the adjustments to obtain resonant frequency of the cavity requires very fine tuning so as not to obtain off-resonance reactance of the cavity. Once the resonant frequency of the cavity is reached, the position of the threaded cavity plunger rod is normally not changed depending upon the type of radio service the tuned resonant frequency cavity is utilized in. There are a number of commercially available cavities manufactured which tune from 30 MHz to above 500 MHz in such desirable frequency ranges such as for and by way of example 30 MHz to 50 MHz, 70 MHz to 90 MHz, 110 MHz, to 150 MHz, 150 MHz to 170 MHz, 200 MHz to 400 MHz, 400 MHz, to 450 MHz and 450 MHz to above 500 MHz, etc. These cavities are appropriately characterized as bandpass cavity filters or notch filters. Such finely threaded tuning rod cavity plunger shafts utilized in the above cavities have been unsatisfactory in that it requires numerous turns to change from one resonant frequency to another resonant frequency. The individual consumes valuable time in continuously turning a finely threaded tuning rod cavity plunger shaft in addition to exhausting the muscle strength in the lower arm extremity of the turner's arm and blistering the palm of the hand. Tuned resonant frequency cavities such as bandpass or notch cavity filters are usually intended to be tuned to a single resonant frequency when used with a transmitting-/receiving station. When cavities are used by radio technicians to eliminate transmitter interference such as transmitter noise and spurious radiation reduction or receiver intermodulation such as receiver selectivity, it is usually necessary to retune the resonant frequency of the cavities over a wide frequency range. The resulting number of turns of a finely threaded tuning cavity rod plunger shaft consumes valuable time of the technician requiring numerous turns of a small knob plus exhausting of the muscles in one's arm and blistering the hand palm involved in turning the finely threaded tuning rod cavity plunger shaft. The turning of the finely threaded rod in changing frequency can sometimes consume up to five minutes or more in changing from one resonant frequency to another depending on how finely the rod is threaded. If the bandpass cavity filter or notch filter has more than one cavity such as two or three, valuable time is consumed and wasted in rotating the finely threaded tuning rod cavity plunger shaft to the resonant frequency of each cavity. The problem of utilizing a finely threaded tuning rod cavity plunger shaft for a cavity filter is overcome by the present invention of an unthreaded tuning cavity rod plunger shaft wherein provisions are provided for coarse adjustment and fine adjustment of tuning the cavity to a predetermined resonant frequency.

SUMMARY OF THE INVENTION

The general purpose of this invention is to provide a cavity tuning assembly that has all the advantages of similarly employed tuned cavities and none of the described disadvantages. To obtain this, the present invention provides a unique fine tune adjustment and coarse tune adjustment for an unthreaded tuning rod cavity plunger shaft of the cavity whereby extended time consuming muscle tiring tuning adjustments are eliminated. An object of the present invention is the provision of a coarse tuned adjustment with the provision of sliding an unthreaded tuning rod shaft through a shaft lock threaded onto threaded bushing which is locked into engagement by a knurl nut compressing together into friction engagement a top split end portion of shaft lock screwed onto the threaded bushing against the unthreaded shaft. Another object is to provide fine tune adjustment with the provision of rotating the engaged shaft lock threaded bushing assembly in and out of a pipe reducer which is locked into engagement against the pipe reducer by a lever lock nut. A further object of the invention is the provision of locking the cavity plunger securely in place for stability of the resonant frequency of the tuned cavity. An additional object of the invention is provision of facilitating quick adjustment of the unthreaded tuning rod cavity plunger shaft to tune the cavity and minimize the external height of unthreaded rod above the tuned cavity to facilitate transportation or storage.

BRIEF DESCRIPTION OF THE DRAWINGS

Other objects and many of the attendant advantages of this invention will be readily appreciated as the same becomes better understood by reference to the following detailed description when considered in connection with the accompanying drawing, in which like reference numerals designate like parts throughout the figures thereof and wherein.

DESCRIPTION OF THE PREFERRED EMBODIMENTS

Figure 1:
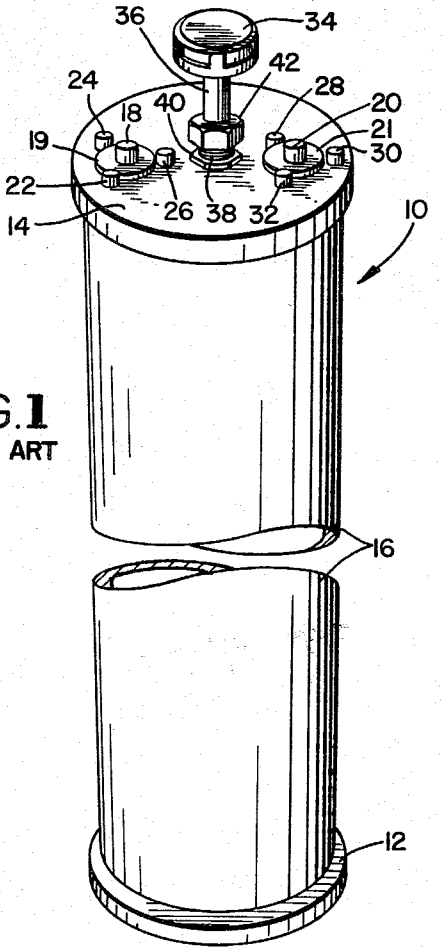
FIG. 1 PRIOR ART
FIG. 1 is a front perspective view of the prior art.

FIG. 1, which illustrates a front perspective view of the prior art shows a single tuned cavity 10 which for and by way of example could be a bandpass cavity filter or a notch filter. Cavity 10 has a bottom plate 12, a top plate 14, and a long cylinder 16 in which internal resonant cavity structure is mounted and supported. The internal tuned resonant frequency cavity structure is not illustrated in the drawing as it is well known in the prior art. Secured to top plate 14 is an input port coaxial connector 18 and an output port coaxial connector 20. Not shown for purposes of illustration are coupled loops, commonly a "J" configuration, attached to the bottom of input port 18 and output port 20 coaxial connectors for coupling radio frequency energy respectively into and out of cavity 10. Input port coaxial connector 18 is mounted on a round circular plate 19 such as for and by way of example welding which is adjustably secured to top plate 14 on its outside circumference by three bolts 22, 24, and 26. Output port coaxial connector 20 is mounted on a round circular plate 21 such as for and by way of example welding which is adjustably secured to top plate 14 on its outside circumference by three bolts 28, 30, and 32. Bolts 22, 24, 26, 28, 30, and 32 are loosened and the round circular plates 19 and 21 respectively having the "J" coupling loop configuration thereon are rotated within a circle prescribed by the respective three bolts for each plate to increase or decrease coupling at the respective input and output ports 18 and 20. Cavity 10 is tuned by way of knob 34 affixed to a finely threaded cavity tuning shaft plunger rod 36 through a tapped threaded split end panel bushing 38 mounted with a nut 40 in a hole in the center portion of top plate 14. A lock nut 42 locks finely threaded cavity tuning shaft plunger rod 36 against bushing 38 which is secured to top plate 14 by nut 40. To vary the resonant frequency of the prior art tuned cavity, it is necessary to disengage lock nut 42 from engagement with panel bushing 38 so as to free finely threaded cavity tuning shaft plunger rod 36 which is then turned to reach a predetermined resonant frequency of the tuned cavity. Depending upon the previous tuned resonant frequency of the cavity, the number of turns required could be one turn or numerous multiple turns. After reaching the predetermined resonant frequency, lock nut 42 is screwed securely into engagement with split end panel bushing 38 so as to lock finely threaded cavity tuning shaft rod 36 into engagement with tapped threaded split end panel bushing 38 for frequency stability of the tuned cavity.

Figure 2:
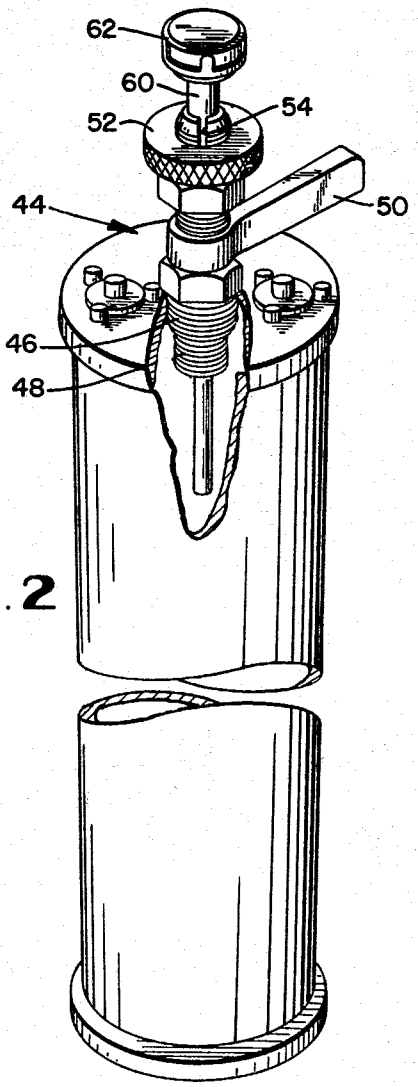
FIG. 2 is a cut away perspective view of the prior art incorporating the preferred embodiment of the invention.

FIG. 2 illustrates a cut away perspective view of cavity tuning assembly 44, the invention, incorporated into the prior art cavity 10 of FIG. 1. Cavity tuning assembly 44 comprises a thread reducer 46 screwed into a tapped threaded center portion of top plate 14 eliminating tapped threaded split end panel bushing 38 and nut 40 of the prior art in FIG. 1. Screwed into said reducer 46 is an elongated threaded bushing 48 whose length is greater than said reducer 46. A lever lock nut 50 locks threaded bushing 48 into engagement with said reducer 46. A knurl nut 52 acts as a shaft lock nut on a shaft lock 54 consisting of a split end top portion and a hexagonal lower portion is screwed onto the top of threaded bushing 48. A smooth cavity tuning shaft plunger rod 60 having a diameter slightly less than the internal diameter of threaded bushing 48 and shaft lock 54 is locked into friction engagement against threaded bushing 48 and shaft lock 54 by knurl nut 52 compressing the split end portion of shaft lock 54 knob 62 is screwed to the top portion of said plunger rod.

Figure 3:
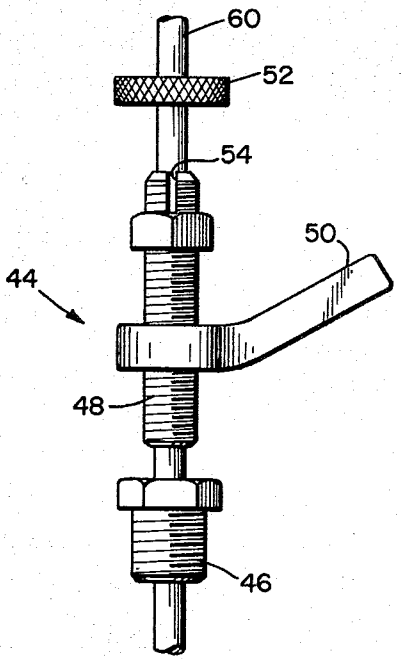
FIG. 3 is an assembled view of the invention separated from the cavity.

FIG. 3 illustrates an assembled view of the cavity tuning assembly 44 invention separated from cavity 10 showing reducer 46 which screws into the tapped center portion of top plate 14 of cavity 10, not shown for purposes of illustration; threaded bushing 48; shaft lock 54 having top split end portion and hexagonal lower portion screwed onto threaded bushing 48; knurl nut 52 which locks cavity tuning shaft plunger rod 60 into compressed friction engagement with shaft lock 54 and threaded bushing 48 by compressing top split end portion of shaft lock 54; and lever lock nut 50 which locks threaded bushing 48, and associated carried structure into engagement with said reducer 46.

PREFERRED MODE OF OPERATION

The operation of cavity tuning assembly 44 in cavity 10 is described with reference being made to FIGS. 2 and 3. Cavity 10 is inserted into a transmission line such as between the receiver input or transmitter output and an antenna. An antenna is connected to coaxial output port 20 and the receiver or transmitter is connected to coaxial input port 18. Other necessary electrical measuring equipment such as a second limiter meter for the receiver or a thruline wattmeter for the transmitter may be inserted into the transmission line as required to tune cavity 10 to resonant frequency. To coarse tune cavity 10, knurl nut 52 is disengaged from shaft lock 54 so that top split end portion of 54 will spread and allow for unthreaded cavity tuning shaft plunger rod 60 to slide up and down through threaded bushing 48 to obtain coarse tune as indicated on the appropriate test instruments. When a desired coarse tune condition is reached as indicated on the test instruments, knurl nut 52 is tightened around top split end portion of shaft lock 54 to engage smooth cavity tuning shaft plunger rod 60 into compressed friction engagement with shaft lock 54. To fine tune, lever lock nut 50 is loosened so as to allow threaded bushing 48; with knurl nut 52 holding unthreaded cavity tuning shaft plunger rod 60 into compressed friction engagement with top split end portion of shaft lock 54 to rotate freely inside said reducer 46. The fine tuning is accomplished by rotating cavity shaft tuning rod 60 which carries threaded bushing 48 shaft lock 54, and knurl nut 52 into or out of pipe reducer 46. When fine tuning is completed, lever lock nut 50 is tightened locking threaded bushing 48 and its associated carried structure into engagement with said reducer 46 for stability of the tuned resonant frequency of cavity 10. When the resonant frequency is changed, the steps in the process of coarse tune adjustment and fine tune adjustment are again repeated. The steps allow for minimum time in which to reach the predetermined resonant frequency of the cavity, and eliminate the need to turn a finely threaded cavity tuning shaft plunger rod 36 such as disclosed in the prior art.

Various modifications are contemplated and may obviously be resorted to by those skilled in the art without departing from the spirit and scope of the invention, as hereinafter defined by the appended claims, as only a preferred embodiment thereof has been disclosed.

What is claimed and desired to be secured by Letters Patent of the United States is:

1. In a tuned resonant frequency cavity having an outside cylinder, a top plate and a bottom plate connected to said cylinder, said top plate having a tapped center hole, the improvement in said tuned resonant frequency cavity comprising means coupled to a smooth shaft for coarse tuning said cavity and a further means coupled to said smooth shaft for fine tuning said cavity said shaft extending through said tapped hole.

2. The improvement of claim 1 wherein said coarse tune means comprises means for friction engagement of said shaft, and first locking means for said shaft.

3. The improvement of claim 2 wherein guide means for said shaft comprises an elongated threaded bushing.

4. The improvement of claim 3 wherein said friction engagement means and first said locking means comprises a shaft lock, screwed onto said elongated threaded bushing, a split end portion on the upper portion of said shaft lock, and a hexagonal portion on the bottom portion of said shaft lock.

5. The improvement of claim 4 wherein said elongated threaded bushing holds said smooth shaft in loose friction engagement so as to insure slidability.

6. The improvement of claim 5 wherein said first locking means comprises a knurl nut screwed onto said split end portion of said shaft lock compressing into friction engagement said smooth shaft with said shaft lock.

7. The improvement of claim 2 wherein said fine tuning means comprises means for fine adjustment by rotating an elongated threaded bushing in pipe reducer means and providing a second locking means for said shaft.

8. The improvement of claim 7 wherein said reducer means comprises a threaded reducer screwed into said tapped hole of said top plate and said threaded busing carrying said first shaft lock rotatably screwed into said reducer.

9. The improvement of claim 8 wherein said second locking means comprises a lever lock nut.

* * * * *